US010704304B2

(12) United States Patent
Nelsen et al.

(10) Patent No.: US 10,704,304 B2
(45) Date of Patent: Jul. 7, 2020

(54) MEMORY LEVERS FOR LATCH MECHANISMS OF VEHICLE COMPARTMENT CLOSURE ASSEMBLIES

(71) Applicants: GM Global Technology Operations LLC, Detroit, MI (US); PyeongHwa Automotive, Daegu (KR)

(72) Inventors: James N. Nelsen, Howell, MI (US); Sung Han Kim, Daegu (KR)

(73) Assignee: GM Global Technology Operations LLC, Detroit, MI (US)

( * ) Notice: Subject to any disclaimer, the term of this patent is extended or adjusted under 35 U.S.C. 154(b) by 422 days.

(21) Appl. No.: 15/794,054

(22) Filed: Oct. 26, 2017

(65) Prior Publication Data

US 2019/0128019 A1 May 2, 2019

(51) Int. Cl.
*E05B 85/26* (2014.01)
*E05B 81/14* (2014.01)
(Continued)

(52) U.S. Cl.
CPC ..... *E05B 85/26* (2013.01); *E05B 81/14* (2013.01); *E05B 83/24* (2013.01); *E05B 81/68* (2013.01)

(58) Field of Classification Search
CPC ..... E05B 81/68; E05B 81/14; E05B 83/24; E05B 83/16; E05B 83/18; E05B 85/26;
(Continued)

(56) References Cited

U.S. PATENT DOCUMENTS 4,468,941 A * 9/1984 Bascou ..... E05B 81/14 70/241
5,074,603 A * 12/1991 Brackmann ..... E05B 81/14 292/201
(Continued)

FOREIGN PATENT DOCUMENTS

CN 1354824 A 6/2002
CN 103573025 A 2/2014
(Continued)

OTHER PUBLICATIONS

Machine Translation of DE 102005015515, 2020, pp. 1-8 (Year: 2020).*
(Continued)

*Primary Examiner* — Christine M Mills
(74) *Attorney, Agent, or Firm* — Quinn IP Law

(57) ABSTRACT

Latch mechanisms for vehicle compartment closure assemblies, methods for making or using such latch mechanisms, and motor vehicles with a latch system for sensing latching/unlatching of a closure assembly are presented. A latch mechanism includes a forkbolt that attaches to the vehicle body and moves between a latched position, engaging a striker and thereby latching a compartment closure assembly in a closed position, and an unlatched position, disengaging the striker. A detent lever attaches to the vehicle body adjacent the forkbolt and moves between a locked position, locking the forkbolt in the latched position, and an unlocked position, disengaging the forkbolt. A memory lever adjacent the forkbolt moves between a catching position, retaining the detent lever in the unlocked position, and a releasing position, disengaging the detent lever. The forkbolt, when moving from the unlatched to the latched position, moves the memory lever from the catching to the releasing position.

20 Claims, 4 Drawing Sheets

(51) Int. Cl.
*E05B 83/24* (2014.01)
*E05B 81/68* (2014.01)

(58) Field of Classification Search
CPC .... Y10S 292/23; Y10S 292/42; Y10S 292/43; Y10S 292/14; Y10T 292/1082; Y10T 292/1047
USPC .. 292/201, 216, DIG. 23, DIG. 14, DIG. 42, 292/DIG. 43
See application file for complete search history.

(56) References Cited

U.S. PATENT DOCUMENTS 5,101,597 A 4/1992 Pelachyk et al.
5,137,311 A * 8/1992 Brackmann ..... E05B 81/14 292/216
5,183,302 A 2/1993 Pelachyk et al.
5,618,069 A 4/1997 Konchan et al.
5,769,468 A * 6/1998 Armbruster ..... E05B 81/20 292/201
5,785,364 A * 7/1998 Kleefeldt ..... E05B 81/22 292/201
5,897,148 A * 4/1999 Arabia, Jr. ..... E05B 85/243 292/209
6,048,002 A * 4/2000 Ohta ..... E05B 81/20 292/201
6,052,948 A 4/2000 Spitzley
6,079,237 A * 6/2000 Hochart ..... E05B 81/14 292/201
6,523,871 B1 2/2003 Josserand
6,594,861 B2 7/2003 Dimig et al.
6,742,818 B2 * 6/2004 Seki ..... E05B 83/16 292/216
6,817,636 B1 * 11/2004 Evans ..... E05B 81/14 292/201
6,880,870 B2 4/2005 Costigan
7,111,878 B2 * 9/2006 Kachouh ..... E05B 81/14 292/201
7,195,090 B2 3/2007 Parks et al.
7,260,964 B2 8/2007 Velicanin et al.
7,506,903 B2 * 3/2009 Sattler ..... B60N 2/20 292/216
7,603,881 B2 * 10/2009 Yukihara ..... B60R 7/06 292/216
7,665,776 B2 2/2010 Lang
8,047,586 B2 11/2011 Pilotelli
8,128,137 B2 3/2012 Takaya et al.
8,182,004 B2 5/2012 Yoda
8,196,507 B2 6/2012 Schafer et al.
8,348,310 B2 * 1/2013 Vazquez ..... E05B 85/26 292/216
8,376,424 B2 2/2013 Bejune
8,388,029 B2 * 3/2013 Pecoul ..... E05B 85/243 292/201
8,419,114 B2 4/2013 Fannon et al.
8,469,411 B2 6/2013 Costigan
8,596,180 B2 12/2013 Schaefer et al.
8,646,816 B2 2/2014 Dziurdzia et al.
8,656,716 B2 2/2014 Schafer
8,894,106 B2 * 11/2014 Vazquez ..... B23P 11/00 292/201
9,062,477 B2 6/2015 Da Deppo et al.
9,376,834 B2 6/2016 Liang et al.
2002/0070564 A1 * 6/2002 Ohta ..... E05B 81/20 292/201
2002/0096889 A1 7/2002 Nelsen et al.
2003/0038484 A1 * 2/2003 Schwaiger ..... E05B 81/14 292/201
2003/0038485 A1 * 2/2003 Schwaiger ..... E05B 81/14 292/201
2004/0004357 A1 * 1/2004 Arlt ..... E05B 81/06 292/201
2006/0006669 A1 1/2006 Nelsen et al.
2009/0039657 A1 2/2009 Schuck
2009/0217809 A1 9/2009 Schafer et al.
2010/0089048 A1 4/2010 Schaefer
2010/0171320 A1 * 7/2010 Cumbo ..... E05B 81/14 292/200
2010/0194120 A1 * 8/2010 Kaiser ..... E05B 81/20 292/198
2011/0012378 A1 1/2011 Ueno et al.
2011/0204659 A1 * 8/2011 Estrada ..... E05B 81/14 292/200
2012/0091738 A1 * 4/2012 Coleman ..... E05B 85/26 292/200
2012/0181798 A1 7/2012 Margheritti et al.
2012/0204562 A1 8/2012 Schafer et al.
2014/0292000 A1 * 10/2014 Vazquez ..... E05B 81/15 292/100
2015/0308161 A1 * 10/2015 Rosales ..... E05B 77/06 292/195

FOREIGN PATENT DOCUMENTS

CN 204876927 U 12/2015
DE 19617428 A1 11/1997
DE 19930339 A1 * 1/2001 ..... E05B 83/16
DE 10336418 A1 3/2005
DE 102005015515 A1 * 10/2006 ..... E05B 85/26
DE 102005056788 A1 * 5/2007 ..... E05B 81/14
DE 202009016636 A1 4/2011
DE 102011114148 A1 * 3/2013 ..... E05B 85/26
DE 102012104775 A1 12/2013
EP 0980948 A1 2/2000
EP 1801331 A1 6/2007
FR 2989407 A1 10/2013

OTHER PUBLICATIONS

Machine Translation of DE 102011114148, 2020, pp. 1-19 (Year: 2020).*

* cited by examiner

MEMORY LEVERS FOR LATCH MECHANISMS OF VEHICLE COMPARTMENT CLOSURE ASSEMBLIES

INTRODUCTION

The present disclosure relates generally to latching systems for compartment closure assemblies of motor vehicles. More specifically, aspects of this disclosure relate to memory levers for single-position latch assemblies of tailgates, liftgates, engine hoods, trunk lids, etc.

Many current production motor vehicles, such as the modern-day automobile, are originally equipped with compartment closure assemblies that are movably mounted to the vehicle body to provide access to the vehicle's various compartments. In automotive applications, driver-side and passenger-side vehicle doors, for example, can be opened and closed to allow user access for entering and exiting the passenger compartment. In contrast, the engine hood (or "bonnet" in some countries) extends over and covers the vehicle's engine compartment to prevent theft or damage of the engine components. A traditional trunk compartment, on the other hand, is a large storage bin located at the rear of the vehicle and covered by a trunk lid that is hinged underneath the passenger compartment's rear deck. By comparison, pickup trucks and other cargo transport vehicles (e.g., sport utility vehicles (SUV), cargo vans, box trucks, etc.) may be typified by a rear cargo compartment that is closed off at the tail end by a hinged liftgate, tailgate, or door assembly. Some automobiles—more commonly referred to as "convertibles"—are equipped with a collapsible roof, while some offer as optional equipment a sunroof panel in the vehicle roof, both of which can be opened for extra sunlight and ventilation for the passenger compartment.

SUMMARY

Disclosed herein are memory levers with ajar switch status-retention features for latch mechanisms of vehicle compartment closure assemblies, methods for making and methods for using such latch mechanisms, and motor vehicles equipped with a latch mechanism employing a memory lever for reliably sensing latching and unlatching of a compartment closure assembly. By way of example, there is presented a novel switch memory lever to help accurately indicate a full-unlatched "ajar" status of a single-position latch mechanism. In this latch mechanism, when the striker is disengaged from a forkbolt, a detent lever disengages the forkbolt and engages an ajar switch that responsively outputs an electronic signal indicating an ajar state of the latch. The memory lever engages with the detent to hold the detent lifted when the forkbolt is disengaged from the striker. This memory lever, which is spring-biased against the detent and deactivated off of the forkbolt, has a catch feature that engages a projection of the detent at a position between latch release and full engagement, but within the zone of switch activation. When the forkbolt moves away from the full-latch position, the memory lever engages the detent to hold it lifted in the absence of support from the forkbolt. As the forkbolt returns to the full-latched position, it temporarily lifts the detent off of the memory lever—holding the detent in engagement with the ajar switch—while moving the memory lever out of position, allowing the detent to drop into locking engagement with the forkbolt.

Attendant benefits for at least some of the disclosed concepts include compartment closure latch mechanisms that provide robust ajar switch sensing yet require reduced packaging space over available counterparts. Disclosed latch designs offer more reliable latch status information, especially for multi-latch tailgate and liftgate systems, helping to reduce or otherwise eliminate false-positive "ajar" status warnings. For multi-function tailgates and liftgates, disclosed latch assemblies maintain a reduced footprint which, in turn, offers greater freedom to incorporate larger lamp assemblies without unnecessarily increasing vehicle width or compromising gate opening.

Aspects of the present disclosure are directed to memory levers with ajar switch status-retention features for latch mechanisms of vehicle compartment closure assemblies. For instance, there is presented a latch mechanism for a compartment closure assembly of a motor vehicle. This compartment closure assembly, which may be in the nature of an engine hood, trunk lid, liftgate, tailgate, driver-side or passenger-side door, etc., is movably mounted to the vehicle body to transition back-and-forth between open and closed positions. The latch mechanism includes a forkbolt that attaches, directly or indirectly, to the vehicle body, and moves back-and-forth between latched and unlatched positions. When in the latched position, the forkbolt engages a striker and thereby latches the compartment closure assembly in the closed position. In contrast, when moved to the unlatched position, the forkbolt disengages the striker such that the closure assembly is movable to the open position.

The latch mechanism of this example also includes a detent lever that attaches, directly or indirectly, to the vehicle body adjacent the forkbolt. This detent lever selectively moves back-and-forth between a locked position, whereat the detent lever engages and locks the forkbolt in the latched position, and an unlocked position, whereat the detent lever disengages and releases the forkbolt. A memory lever attaches, directly or indirectly, to the vehicle body adjacent the forkbolt to selectively move back-and-forth between catching and releasing positions. When moved to the catching position, the memory lever engages and retains the detent lever in the unlocked position. Conversely, when moved to the releasing position, the memory lever disengages and frees the detent lever. The forkbolt, when moving from the unlatched position to the latched position, disengages the detent lever from the memory lever and concurrently moves the memory lever from the catching to the releasing position.

Other aspects of the present disclosure are directed to motor vehicles equipped with a latch and lock system for latching closed and governing the opening of a compartment closure assembly. As used herein, the term "motor vehicle" may include any relevant vehicle platform, such as passenger vehicles (internal combustion engine, hybrid electric, full electric, fuel cell, fuel cell hybrid, fully or partially autonomous, etc.), commercial vehicles, industrial vehicles, tracked vehicles, off-road and all-terrain vehicles (ATV), farm equipment, boats, airplanes, etc. A motor vehicle is presented that includes a vehicle body with a passenger compartment for or aft of an interior compartment (e.g., engine bay, trunk, trailer, etc.). Covering an access opening to this interior compartment is a closure assembly that is pivotably mounted to the vehicle body. This closure assembly is manually and/or automatically movable between an open position, providing access to the interior compartment, and a closed position, obstructing access to the interior compartment. A striker, which may include a striker bolt or a U-shaped striker pin, is supported on a striker plate attached to the vehicle body (e.g., in a tailgate or liftgate application) or to the compartment closure assembly (e.g., in a hood latch application).

Continuing with the above example, the motor vehicle is equipped with a latch mechanism operatively connected to a release mechanism, which is located inside the passenger compartment and selectively actuable to disengage the latch mechanism. This latch mechanism includes a latch housing that is mounted to the vehicle body. A forkbolt is rotatably mounted to the latch housing to selectively transition between a latched position, engaging the striker and thereby latching the closure assembly in the closed position, and an unlatched position, disengaging the striker such that the closure assembly is movable to the open position. A detent lever is rotatably mounted to the latch housing adjacent the forkbolt to transition between a locked position, engaging and locking the forkbolt in the latched position, and an unlocked position, whereat the release mechanism disengages the detent lever from the forkbolt. A memory lever is rotatably mounted to the latch housing adjacent the detent lever to transition between catching and releasing positions. The memory lever, when in the catching position, engages and retains the detent lever in the unlocked position. When moved to the releasing position, the memory lever disengages the detent lever. The forkbolt, when moved to the latched position, disengages the detent lever from the memory lever and concurrently moves the memory lever to the releasing position.

Additional aspects of this disclosure are directed to methods for making and methods for using any of the herein depicted or described vehicle latch assemblies. For instance, a method is presented for assembling a compartment closure latch mechanism of a motor vehicle. The representative method includes, in any order and in any combination with any of the disclosed features and options: attaching a forkbolt to the vehicle body to selectively move between a latched position, whereat the forkbolt engages the striker and thereby latches the compartment closure assembly in the closed position, and an unlatched position, whereat the forkbolt disengages the striker such that the closure assembly is movable to the open position; attaching a detent lever to the vehicle body adjacent the forkbolt to selectively move between a locked position, whereat the detent lever engages and locks the forkbolt in the latched position, and an unlocked position, whereat the detent lever disengages and frees the forkbolt; and, attaching a memory lever to the vehicle body adjacent the forkbolt to move between a catching position, whereat the memory lever engages and catches the detent lever in the unlocked position, and a releasing position, whereat the memory lever disengages the detent lever. The forkbolt, when moving from the unlatched position to the latched position, moves the memory lever from the catching position to the releasing position.

The above summary is not intended to represent every embodiment or every aspect of the present disclosure. Rather, the foregoing summary merely provides an exemplification of some of the novel concepts and features set forth herein. The above features and advantages, and other features and advantages of this disclosure, will be readily apparent from the following detailed description of illustrative embodiments and representative modes for carrying out the present disclosure when taken in connection with the accompanying drawings and the appended claims. Moreover, this disclosure expressly includes any and all combinations and subcombinations of the elements and features presented above and below.

Figure 1:
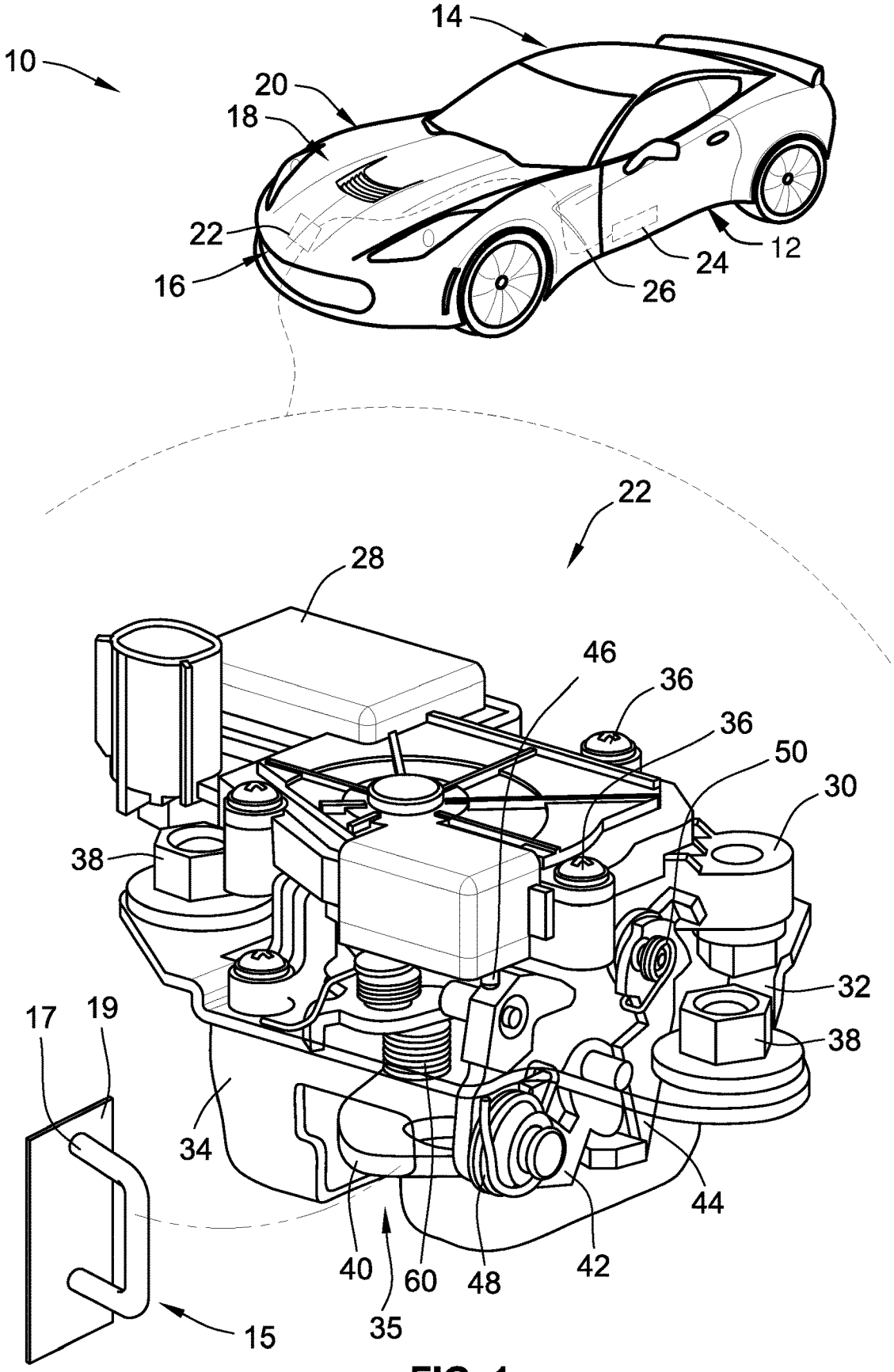
FIG. 1 is an elevated, front perspective-view illustration of a representative motor vehicle with an inset view of a representative compartment closure latch mechanism with a switch memory lever in accordance with aspects of the present disclosure.

The present disclosure is amenable to various modifications and alternative forms, and some representative embodiments have been shown by way of example in the drawings and will be described in detail herein. It should be understood, however, that the novel aspects of this disclosure are not limited to the particular forms illustrated in the appended drawings. Rather, the disclosure is to cover all modifications, equivalents, combinations, subcombinations, permutations, groupings, and alternatives falling within the scope of this disclosure as defined by the appended claims.

DETAILED DESCRIPTION

This disclosure is susceptible of embodiment in many different forms. There are shown in the drawings and will herein be described in detail representative embodiments of the disclosure with the understanding that these illustrated examples are provided as an exemplification of the disclosed principles, not limitations of the broad aspects of the disclosure. To that extent, elements and limitations that are described, for example, in the Abstract, Summary, and Detailed Description sections, but not explicitly set forth in the claims, should not be incorporated into the claims, singly or collectively, by implication, inference or otherwise.

For purposes of the present detailed description, unless specifically disclaimed: the singular includes the plural and vice versa; the words "and" and "or" shall be both conjunctive and disjunctive; the word "all" means "any and all"; the word "any" means "any and all"; and the words "including" and "comprising" and "having" mean "including without limitation." Moreover, words of approximation, such as "about," "almost," "substantially," "approximately," and the like, may be used herein in the sense of "at, near, or nearly at," or "within 0-5% of," or "within acceptable manufacturing tolerances," or any logical combination thereof, for example. Lastly, directional adjectives and adverbs, such as fore, aft, inboard, outboard, starboard, port, vertical, horizontal, upward, downward, front, back, etc., are with respect to a motor vehicle, such as a forward driving direction of a motor vehicle when the vehicle is operatively oriented on a normal driving surface, for example.

Aspects of the present disclosure provide a memory lever with an ajar switch status-retention feature that holds the detent in a lifted position when the forkbolt disengages the striker pin, which functions to reliably retain activated the ajar switch. As the forkbolt moves towards the latched position, e.g., under the force of a moving striker, the forkbolt pushes the memory lever out of engagement with the detent while driving the detent up slightly to lift it over an edge of an engagement surface of the forkbolt. The detent is thereby allowed to drop into engagement with the forkbolt; when this occurs, the ajar switch output signal changes from open to closed (e.g., switch itself changes from "on" (closed) to "off" (open)). The differential position of the detent between the just-released condition and the full-open condition helps to ensure a seamless interaction between the detent, memory lever, and fork bolt. For example, if the latch mechanism is released, but the compartment closure does not move sufficiently within the release pulse, the detent will be dropped either onto a forkbolt surface or a memory lever surface; in either case, it will be supported in a position that activates the ajar switch. If the detent drops onto the forkbolt first, as the closure is opened, it will drop further onto the retaining notch of the memory lever. Conversely, as the gate is closed, the forkbolt lifts the detent while simultaneously pushing the memory lever out of engagement with the detent. Thus, the detent is prevented from moving into an undesirable position that would give a false latch signal. In addition, the latch mechanism architecture helps to ensure that the memory lever cannot interfere with the ability of the latch to be re-engaged.

Referring now to the drawings, wherein like reference numbers refer to like features throughout the several views, there is shown in FIG. 1 a representative automobile, which is designated generally at 10 and portrayed herein for purposes of discussion as a two-seat coupe-style passenger vehicle. Mounted to the vehicle body 12, e.g., forward of a vehicle passenger compartment 14 and aft of a front bumper assembly 16, is an engine hood assembly 18 that extends across and covers the upper extent of an engine compartment 20. The illustrated automobile 10—also referred to herein as "motor vehicle" or "vehicle" for short—is merely an exemplary application with which novel aspects and features of this disclosure may be practiced. In the same vein, implementation of the present concepts into a front-engine-layout hood assembly should also be appreciated as a representative application of the novel aspects and features disclosed herein. As such, it will be understood that aspects and features of this disclosure may be integrated into various types of engine and hood layouts, applied to other compartment closure assemblies, and implemented for any logically relevant type of motor vehicle. As an example, it is envisioned that the disclosed latch assemblies be integrated into multi-latch tailgate and liftgate systems of pickup trucks and sport utility vehicles. Lastly, the drawings presented herein are not necessarily to scale and are provided purely for instructional purposes. Thus, the specific and relative dimensions shown in the drawings are not to be construed as limiting.

Engine hood assembly 18 of FIG. 1 (also referred to herein as "compartment closure assembly" or "closure assembly") is pivotally mounted to one or more load-bearing body frame members of the vehicle 10 to provide access to and securely close the top portion of the engine compartment 20. For instance, the hood assembly 18 may be pivotally mounted via a pair of dual-point hinges with pneumatic cylinder actuators to the lateral engine compartment rails (not visible in the views provided) of the vehicle body 12. The vehicle 10 is equipped with a latch and lock system that employs a concealed latch mechanism 22 to secure the engine hood assembly 18 in a closed position, as shown in FIG. 1. A latch release mechanism 24, shown located inside the passenger compartment 14, e.g., underneath the steering column or adjacent the driver seat frame, includes a lever, a button or other user interface that is pulled, pressed or otherwise activated to disengage the latch mechanism 22 such that the hood assembly 18 can be manually or automatically opened. In a mechanical system architecture, pulling on a release lever of the release mechanism 24 will apply a tensile force to a latch release cable 26. The loaded release cable 26 of the latch and lock system, which may be a Bowden-type cable, activates and thereby disengages the latch mechanism 22 at the front end of the engine hood assembly 18 opposite the hinge mount. This allows the hood assembly 18 to be moved to an open position, e.g., under the biasing force of the pneumatic cylinders. Other mounting and latching architectures, including mechanical, electrical, and electro-mechanical configurations, are envisioned as being within the scope of this disclosure. For instance, the release cable 26 may be representative of an electrical wire harness or fiber optic cable, e.g., in applications where the latch mechanism 22 is embodied as a power latch, as described in further detail below.

Presented in the inset view of FIG. 1 is an electronically actuated ("power") latch mechanism 22 for regulating the opening and closing of the compartment closure assembly 18. The representative latch mechanism 22 is provided with a rigid, robust and corrosion-resistant latch housing that is generally composed of a housing cover 28, a lower housing bracket 30, housing cover plate 32, and a housing frame plate 34. Housing cover 28 is shown in FIG. 1 mechanically coupled, e.g., via self-locking pan-head bolts 36, onto the lower housing bracket 30 and housing cover plate 32. Housing cover plate 32, in turn, is mechanically coupled, e.g., via flanged hex-head nuts 38, to the housing frame plate 34, which provides functional mounting support for the entire latch mechanism 22. According to the illustrated design, for example, the latch mechanism 22 is rigidly mounted via frame plate 34, e.g., to a tie bar cross-member (not visible in the views provided) of the vehicle body 12. It may be desirable that the constituent parts of the latch housing be constructed of a strong yet lightweight material, such as thermoplastic polymers and other plastic materials, or aluminum, steel and other metals, or combinations thereof. Clearly, the shape, size and/or number of housing parts may be modified, for example, to accommodate packaging and design requirements for different vehicle platforms. In this regard, the illustrated latch mechanism 22 is purely representative and, thus, non-limiting of the inventive concepts disclosed herein.

Housing cover 28 is constructed to conceal and protect a servo motor and gear components (none of which are visible in the views provided) for selectively disengaging a forkbolt 40 from a striker 15 through cooperative operation between the forkbolt 40, a detent lever 42 and a memory lever 44, as will be described in extensive detail hereinbelow. The aforementioned motor and gear components, as well as an electronic ajar switch 46, are mechanically supported on the lower housing bracket 30. Functional support for the forkbolt 40, detent lever 42 and memory lever 44, as well as a pair of bias members 48 and 50, is provided by the housing cover plate 32. Shifting of the forkbolt 40 may be accomplished by an internal drive architecture comprised of a two-way ("reversible") electric servomotor that transfers driving power through a gear train (e.g., worm gear engaging a spur gear) to synchronously rotate the detent lever 42. Operation of this motor is accomplished through electronic command signals from a vehicle controller or dedicated control module, which are generated responsive to activation of the release mechanism 24. In so doing, the detent lever 42 disengages from the forkbolt 40, allowing the forkbolt 40 to disengage from a striker pin 17 that is mounted to the hood assembly 18 via a striker plate 19.

With continuing reference to FIG. 1, it is seen that the latch mechanism housing, namely frame plate 34, is fabricated with a fish mouth opening, generally indicated as 35, for receiving the striker pin 17 when the engine hood assembly 18 is drawn closed. Forkbolt 40 is stowed within frame plate 34, pivotally mounted to the cover plate 32, e.g., via a pivot pin 52 (FIG. 2A), to selectively rotate about a first axis A1 (FIG. 3A) between a latched position (FIGS. 2A and 2B) and an unlatched position (FIGS. 4A and 4B). When in the latched position, a throat 41 (FIG. 2B) of the forkbolt 40 receives and captures the striker pin 17, thereby securing the compartment closure assembly 18 in the closed position. Detent lever 42 is pivotally mounted on the housing cover plate 32 adjacent the forkbolt 40, e.g., via a respective pivot pin 54 (FIG. 2A), to selectively rotate about a second axis A2 (FIG. 3A), which is substantially perpendicular to the first axis A1, between a locked position (FIGS. 2A and 2B) and an unlocked position (FIGS. 4A and 4B). Upon being moved to the locked position, a detent cavity 43 (FIG. 2B) of the detent lever 42 engages with a forkbolt finger 45 of the forkbolt 40 to lock the forkbolt 40 in the latched position shown in FIG. 2A. First bias member 48, which is portrayed in the drawings as a helical torsion spring, pushes the detent lever 42 towards this locked position. While the forkbolt 40 and detent lever 42 are engaged in this manner such that the latch mechanism 22 is in the full-closed state, forkbolt 40 holds the memory lever 44 in a releasing position (FIGS. 2A and 2B), disengaged from the detent lever 42.

Figure 2B:
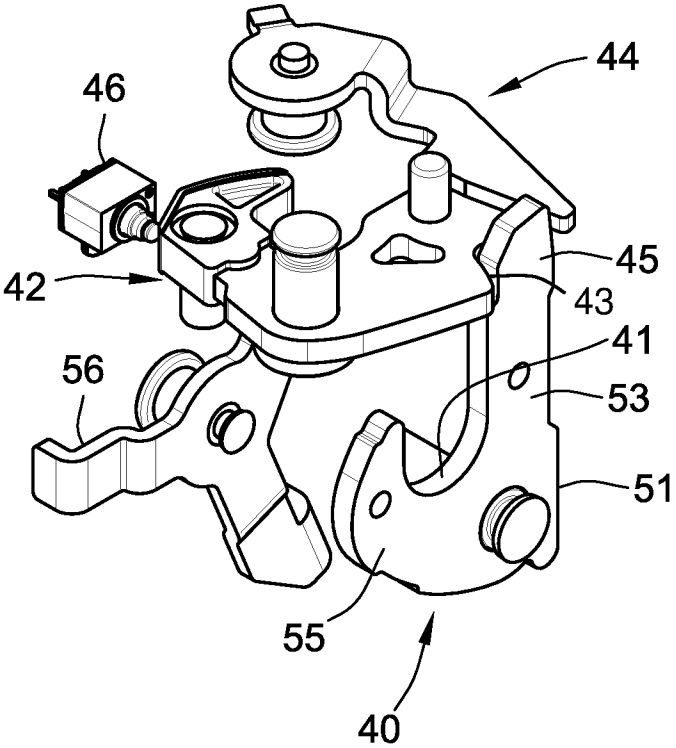
FIGS. 2A and 2B are side-view and perspective-view illustrations, respectively, of the forkbolt, detent lever and memory lever of FIG. 1 when the representative latch mechanism is in the full-closed state.

FIGS. 4A and 4B illustrate the forkbolt 40, detent lever 42 and memory lever 44 when the latch mechanism 22 is in a full-open state. In particular, the detent lever 42 is rotated, e.g., in a counterclockwise direction in FIG. 3A, to an unlocked position in which the detent lever 42 is lifted away and disengaged from and the forkbolt 40. Detent lever 42 is moved to this unlocked/disengaged position by a detent crank 56, the rotation of which is controlled through operation of the latch mechanism 22 motor and gear train described above. This will permit the forkbolt 40 to be rotated, e.g., in a counterclockwise direction in FIG. 3B, to the unlatched position of FIG. 4B. A third bias member 60, which is also portrayed as a helical torsion spring in FIG. 1, pushes the forkbolt 40 towards this unlatched position. In so doing, the forkbolt throat 41 releases or otherwise disengages from the striker 15 such that the closure assembly 18 is movable to the open position. Memory lever 44 is pivotally mounted to the housing cover plate 32, e.g., via a dedicated pivot pin 58 (FIG. 2A), adjacent the forkbolt 40 and detent lever 42 to selectively rotate about a third axis A3 (FIG. 3A) between a releasing position (FIGS. 2A and 2B) and a catching position (FIGS. 4A and 4B). As seen in FIG. 3A, the axis A3 of the memory lever 44 is substantially perpendicular to the axis A1 of the forkbolt 40 and substantially parallel to the axis A2 of the detent lever 42. When moved to the catching position, e.g., in a clockwise direction in FIG. 3A, this memory lever 44 engages and catches the detent lever 42 in the unlocked position. This, in turn, helps to ensure that the ajar switch 46 remains activated and, thus, continuously outputs electronic signals indicating the engine hood assembly 18 is open. Second bias member 50, which is depicted as a helical torsion spring in FIG. 1, pushes the memory lever 44 to the catching position shown in FIGS. 4A and 4B.

According to the illustrated architecture, the forkbolt 40 is fabricated with a single-piece, J-shaped forkbolt body 51 (FIG. 2B) that is integrally formed with an elongated stem 53 and a hooked descender 55 that projects generally transversely from a proximal end of the stem 53. Forkbolt finger 45 projects in a longitudinal direction from a distal end of the stem 53, whereas the curved section of the hooked descender 55 defines the throat 41. Likewise, the detent lever 42 is fabricated with a single-piece, L-shaped detent body 57 (FIG. 2A) that is integrally formed with an elongated stem 59 and a leg 61 that projects generally orthogonally from a proximal end of the stem 59. Overmolded on a distal end of the stem 59 is a cam surface 49, whereas the leg 61 defines the detent cavity 43 and is formed or machined with a ramped surface 63. An elongated, cylindrical detent pin 62 is integrally formed with, and projects orthogonally from, a distal end of the leg 61 proximal the detent cavity 43 (FIG. 2B). The memory lever 44 is fabricated with a single-piece, C-shaped memory lever body 65 that is integrally formed with a central stress section 67 and a leg section 69 that cooperatively define a catch shelf 71. An elongated stop tab 73 is integrally formed with, and projects radially outward from, a circular arm section 75 of the memory lever body 65. In the same vein, a triangular toe 77 projects from a distal end of the leg section 69.

Figure 2A:
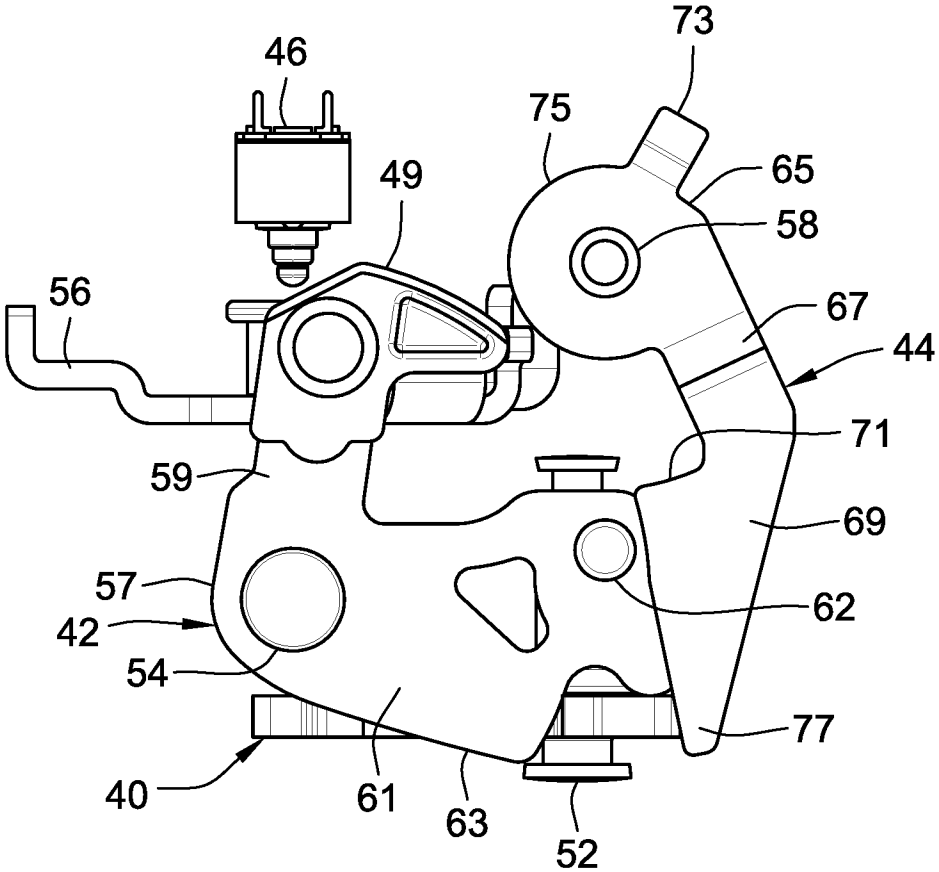
Figure 3B:
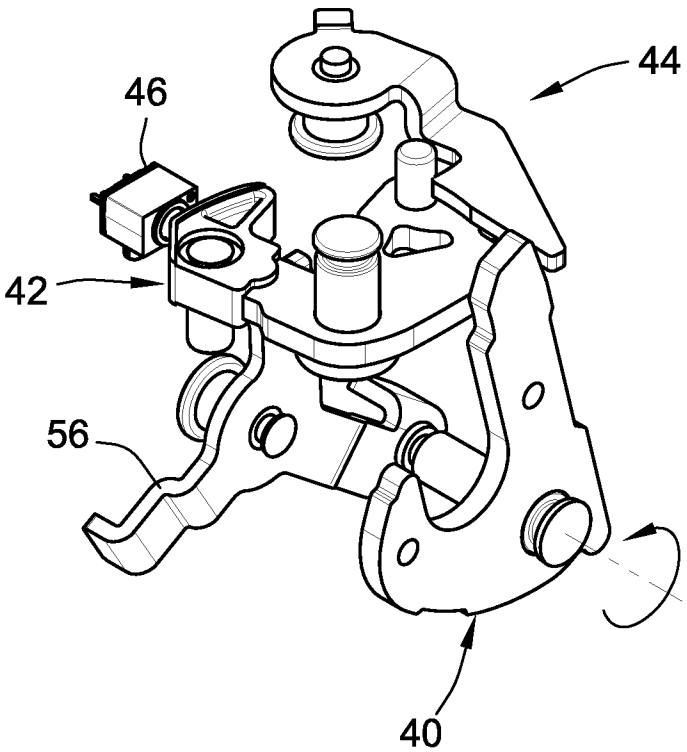
FIGS. 3A and 3B are side-view and perspective-view illustrations, respectively, of the forkbolt, detent lever and memory lever of FIG. 1 when the representative latch mechanism is in a released state.
Figure 3A:
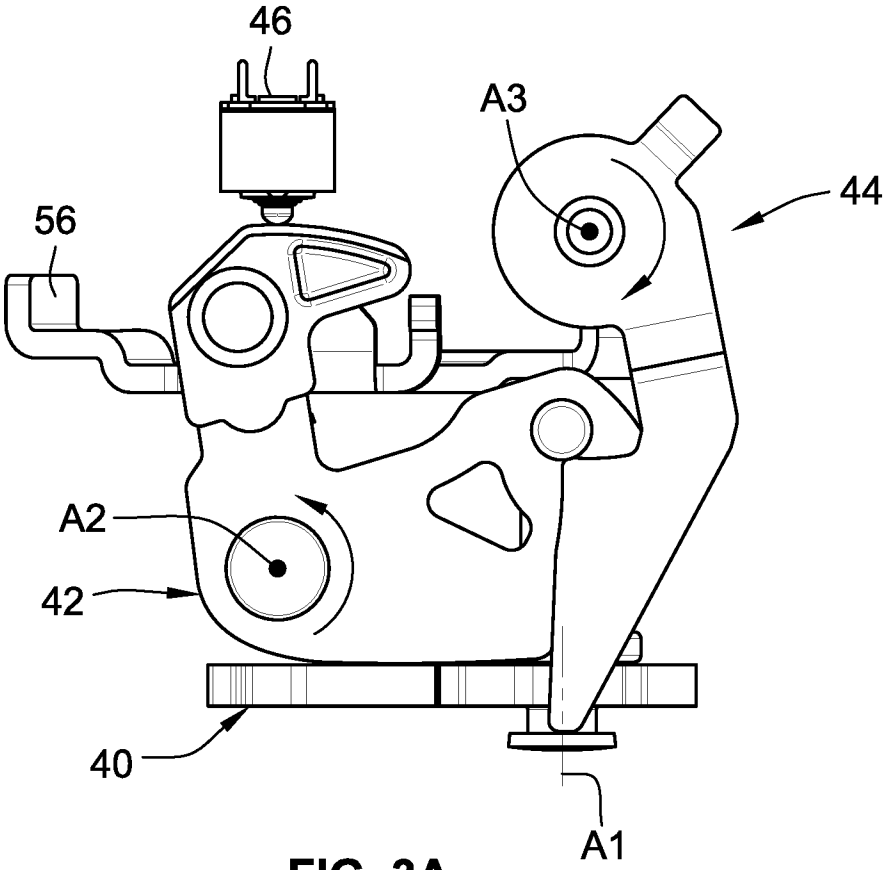
Figure 4B:
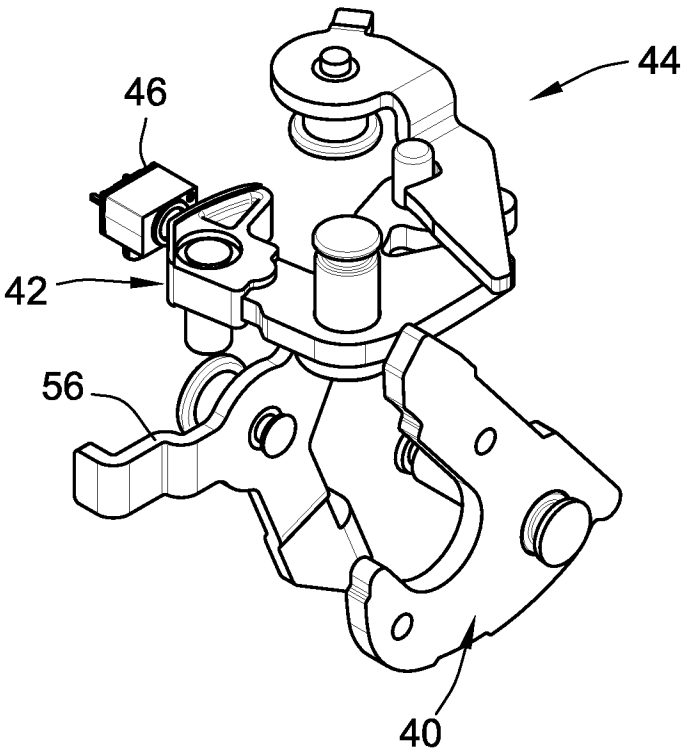
FIGS. 4A and 4B are side-view and perspective-view illustrations, respectively, of the forkbolt, detent lever and memory lever of FIG. 1 when the representative latch mechanism is in the full-open state.
Figure 4A:
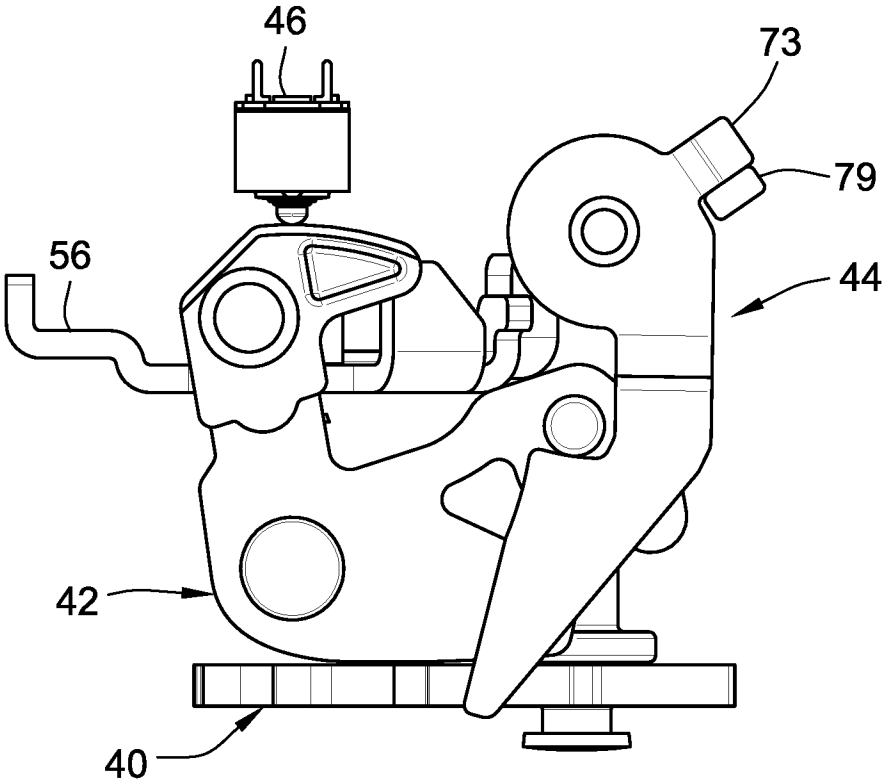

During operation of the latch mechanism 22, cam surface 49 rotates with the detent body 57 around axis A2 to slidably engage with and actuate the ajar switch 46 as the detent lever 42 is moved from the locked to the unlocked position (e.g., from FIG. 2A, through FIG. 3A, to FIG. 4A). As the detent lever 42 transitions to this unlocked position, forkbolt finger 45 unseats from the detent cavity 43, and the detent leg 61 concurrently rotates away from the forkbolt 40. When the detent body 57 is sufficiently rotated such that the ramped surface 63 clears the forkbolt body 51, thus allowing the forkbolt 40 to complete its rotation to the unlatched position, detent pin 62 seats on the catch shelf 71 of the memory lever 44, which is concomitantly rotating to the catching position. During transition of the latch mechanism 22 to the full-open state, rotation of the memory lever 44 may be limited to the catching position by the stop tab 73 engaging a stop shoulder 79 of the latch housing, as best seen in FIG. 4A.

Conversely, when the forkbolt 40 rotates from the unlatched to the latched position during transition of the latch mechanism 22 to the full-closed state (e.g., from FIG. 4B, through FIG. 3B, to FIG. 2B), the forkbolt finger 45 slidably presses against the detent's ramped surface 63, as best seen in FIG. 3B. This causes the detent body 57 to rotate, e.g., in a counterclockwise direction in FIG. 3A, whereby the detent pin 62 is lifted off of the catch shelf 71 and the detent lever 42 is operatively disengaged from the memory lever 44. At the same time, forkbolt 40 shifts the memory lever 44 away from the detent lever 42, rotating the memory lever body 65, e.g., in a counterclockwise direction in FIG. 3A, from the catching position of FIG. 4A to the releasing position of FIG. 2A. In particular, as forkbolt finger 45 presses against the ramped surface 63, the finger 45 also pushes against the triangular toe 77 until the memory lever 44 reaches the releasing position. Once the forkbolt finger 45 clears the detent's ramped surface 63, the detent lever 42 rotates, e.g., in a clockwise direction in FIG. 3A, such that the finger 45 seats within the recessed cavity 43 and presses against the detent body 57. In so doing, the detent lever 42 is retained in the locked position and the forkbolt 40 is retained in the latched position of FIGS. 2A and 2B.

Aspects of the present disclosure have been described in detail with reference to the illustrated embodiments; those skilled in the art will recognize, however, that many modifications may be made thereto without departing from the scope of the present disclosure. The present disclosure is not limited to the precise construction and compositions disclosed herein; any and all modifications, changes, and variations apparent from the foregoing descriptions are within the scope of the disclosure as defined by the appended claims. Moreover, the present concepts expressly include any and all combinations and subcombinations of the preceding elements and features.

What is claimed:

1. A latch mechanism for a compartment closure assembly of a motor vehicle, the compartment closure assembly being movably mounted to a vehicle body of the motor vehicle to transition between an open position and a closed position, the motor vehicle including a striker attached to the vehicle body or the compartment closure assembly, the latch mechanism comprising:

a forkbolt configured to rotatably attach to the motor vehicle and rotate about a first axis between a latched position, whereat the forkbolt engages the striker and thereby latches the compartment closure assembly in the closed position, and an unlatched position, whereat the forkbolt disengages the striker such that the compartment closure assembly is movable to the open position;

a detent lever configured to rotatably attach to the motor vehicle adjacent the forkbolt and rotate about a second axis, substantially perpendicular to the first axis, between a locked position, whereat the detent lever engages and locks the forkbolt in the latched position, and an unlocked position, whereat the detent lever disengages the forkbolt; and a rigid memory lever configured to rotatably attach to the motor vehicle adjacent the forkbolt and rotate about a third axis, substantially parallel to the second axis, between a catching position, whereat the memory lever engages and catches the detent lever in the unlocked position, and a releasing position, whereat the memory lever disengages the detent lever, wherein the forkbolt, when moving from the unlatched position to the latched position, moves the memory lever from the catching position to the releasing position.

2. The latch mechanism of claim 1, wherein the memory lever includes a memory lever body with a catch shelf, and the detent lever includes a detent lever body with a detent pin projecting therefrom, the detent pin seating on the catch shelf when the memory lever is in the catching position and the detent lever is in the unlocked position.

3. The latch mechanism of claim 2, wherein the detent pin projects transversely from the detent lever body and is substantially perpendicular to the first axis.

4. The latch mechanism of claim 1, wherein the memory lever includes a memory lever body with a toe projecting therefrom, and the forkbolt includes a forkbolt lever body with a finger projecting therefrom, the finger pressing against the toe and pushing the memory lever to the releasing position when the forkbolt moves from the unlatched to the latched position.

5. The latch mechanism of claim 1, wherein the detent lever includes a detent lever body with a ramped surface, and the forkbolt includes a forkbolt body with a finger projecting therefrom, the finger pressing against the ramped surface and disengaging the detent lever from the memory lever when the forkbolt moves from the unlatched to the latched position.

6. The latch mechanism of claim 1, wherein the detent lever includes a detent lever body with a recessed cavity, and the forkbolt includes a forkbolt body with a finger projecting therefrom, the finger seating in the recessed cavity and pressing against the detent lever body when the detent lever is in the locked position and the forkbolt is in the latched position.

7. The latch mechanism of claim 1, further comprising a housing with a stop shoulder, wherein the memory lever includes a memory lever body rotatably mounted to the housing and including a stop tab projecting therefrom, the stop tab engaging the stop shoulder to thereby limit rotation of the memory lever to the catching position.

8. The latch mechanism of claim 1, wherein the third axis is substantially perpendicular to the first axis.

9. The latch mechanism of claim 1, wherein the motor vehicle includes an ajar switch actuable to generate an electronic signal indicating the compartment closure assembly is in the open position, and the detent lever includes a detent lever body with a cam surface, the cam surface being configured to engage and actuate the ajar switch when the detent lever is moved to the unlocked position.

10. The latch mechanism of claim 1, further comprising a first bias member biasing the detent lever to the locked position.

11. The latch mechanism of claim 10, further comprising a second bias member biasing the memory lever to the catching position.

12. The latch mechanism of claim 1, wherein the forkbolt includes a forkbolt body rotatably attached to the vehicle body and defining a throat configured to receive and capture therein the striker attached to the compartment closure assembly.

13. The latch mechanism of claim 1, further comprising a latch housing configured to mount on the vehicle body of the motor vehicle, the forkbolt, the detent lever, and the memory lever each being rotatably mounted to the latch housing at a respective pivot position.

14. A motor vehicle comprising:

a vehicle body with a compartment;

a compartment closure assembly movably mounted to the vehicle body to transition between an open position, providing access to the compartment, and a closed position, obstructing access to the compartment;

a striker attached to either the vehicle body or the compartment closure assembly;

a release mechanism located within the passenger compartment; and a latch mechanism, including:

a latch housing mounted to either the compartment closure assembly or the vehicle body;

a forkbolt rotatably mounted to the latch housing to selectively rotate about a first axis between a latched position, whereat the forkbolt engages the striker and thereby latches the compartment closure assembly in the closed position, and an unlatched position, whereat the forkbolt disengages the striker such that the compartment closure assembly is movable to the open position;

a detent lever rotatably mounted to the latch housing adjacent the forkbolt to rotate about a second axis, substantially perpendicular to the first axis, between a locked position, whereat the detent lever engages and locks the forkbolt in the latched position, and an unlocked position, whereat the release mechanism disengages the detent lever from the forkbolt; and a rigid memory lever rotatably mounted to the latch housing adjacent the detent lever to rotate about a third axis, substantially parallel to the second axis, between a catching position, whereat the memory lever engages and catches the detent lever in the unlocked position, and a releasing position, whereat the memory lever disengages the detent lever, wherein the forkbolt, when moving from the unlatched position to the latched position, disengages the detent lever from the memory lever and concurrently moves the memory lever from the catching position to the releasing position.

15. A method of assembling a latch mechanism for a compartment closure assembly of a motor vehicle, the compartment closure assembly being movably mounted to a vehicle body of the motor vehicle to transition between an open position and a closed position, the motor vehicle including a striker attached to the vehicle or the compartment closure assembly, the method comprising:

attaching a forkbolt to the motor vehicle to rotate about a first axis between a latched position, whereat the forkbolt engages the striker and thereby latches the compartment closure assembly in the closed position, and an unlatched position, whereat the forkbolt disengages the striker such that the compartment closure assembly is movable to the open position;

attaching a detent lever to the motor vehicle adjacent the forkbolt to rotate about a second axis, substantially perpendicular to the first axis, between a locked position, whereat the detent lever engages and locks the forkbolt in the latched position, and an unlocked position, whereat the detent lever disengages the forkbolt; and attaching a rigid memory lever to the motor vehicle adjacent the forkbolt to rotate about a third axis, substantially parallel to the second axis, between a catching position, whereat the memory lever engages and catches the detent lever in the unlocked position, and a releasing position, whereat the memory lever disengages the detent lever, wherein the forkbolt, when moving from the unlatched position to the latched position, moves the memory lever from the catching position to the releasing position.

16. The method of claim 15, wherein the memory lever includes a memory lever body with a catch shelf, and the detent lever includes a detent lever body with a detent pin projecting therefrom, the detent pin seating on the catch shelf when the memory lever is in the catching position and the detent lever is in the unlocked position.

17. The method of claim 15, wherein the memory lever includes a memory lever body with a toe projecting therefrom, and the forkbolt includes a forkbolt lever body with a finger projecting therefrom, the finger pressing against the toe and pushing the memory lever to the releasing position when the forkbolt moves from the unlatched to the latched position.

18. The method of claim 15, wherein the detent lever includes a detent lever body with a ramped surface, and the forkbolt includes a forkbolt body with a finger projecting therefrom, the finger pressing against the ramped surface and disengaging the detent lever from the memory lever when the forkbolt moves from the unlatched to the latched position.

19. The method of claim 15, wherein the detent lever includes a detent lever body with a recessed cavity, and the forkbolt includes a forkbolt body with a finger projecting therefrom, the finger seating in the recessed cavity and pressing against the detent lever body when the detent lever is in the locked position and the forkbolt is in the latched position.

20. The method of claim 15, further comprising mounting a latch housing on the vehicle body, wherein the attaching the forkbolt, the attaching the detent lever, and the attaching the memory lever each includes rotatably mounting a respective one of the forkbolt, the detent lever, and the memory lever to the latch housing at a corresponding pivot position.

* * * * *